US005398014A

United States Patent [19]

Stegmaier et al.

[11] Patent Number: 5,398,014

[45] Date of Patent: Mar. 14, 1995

[54] CORE HAVING EARTH CONTACTING

[75] Inventors: Friedrich Stegmaier; Dieter Betz, both of Magstadt; Reinhold Herrmann, Constance, all of Germany

[73] Assignee: Robert Bosch GmbH, Stuttgart, Germany

[21] Appl. No.: 162,069

[22] PCT Filed: Apr. 24, 1992

[86] PCT No.: PCT/DE92/00330

§ 371 Date: Dec. 9, 1993

§ 102(e) Date: Dec. 9, 1993

[87] PCT Pub. No.: WO92/22744

PCT Pub. Date: Dec. 23, 1992

[30] Foreign Application Priority Data

Jun. 13, 1991 [DE] Germany ..... 41 19 413.6

[51] Int. Cl.[6] ..... H01F 27/24

[52] U.S. Cl. ..... 336/234; 310/216; 439/92; 439/431

[58] Field of Search ..... 310/216; 439/92, 431, 439/433; 336/233, 234, 210

[56] References Cited

U.S. PATENT DOCUMENTS 1,727,219 9/1929 Scharf et al. ..... 439/433
2,135,937 11/1938 Gordon ..... 439/431

FOREIGN PATENT DOCUMENTS 0418137 3/1991 European Pat. Off. .
673231 1/1930 France .
2441910 6/1980 France .
3528803 2/1987 Germany .

*Primary Examiner*—Thomas J. Kozma
*Attorney, Agent, or Firm*—Michael J. Striker

[57] ABSTRACT

A core for an ignition coil comprises a core element formed as a core stack with a plurality of laminations and having a mounting bore with an insulating layer, a connecting element for connecting the core element to a holder and inserted in the mounting bore, and elements for establishing an earth contact between the core element and the connecting element and including a projection formed by at least one of the laminations of the core stack formed so that the projection extends into the mounting bore and when the connecting element is inserted into the mounting bore it removes the insulating layer from the projection and establishes the earth contact.

5 Claims, 2 Drawing Sheets

CORE HAVING EARTH CONTACTING

BACKGROUND OF THE INVENTION

The present invention relates to a core having earth contacting.

More particularly, it relates to a coil having an iron core, in particular an ignition coil consisting of a primary and secondary winding which are inductively coupled by an iron core.

Such an iron core normally consists of a multiplicity of individual thin laminations which are, for example, punched, insulated by varnishing and subsequently packed one above another to form a core stack. During stacking, the individual laminations are, for example, riveted or welded to one another, so that the laminations are electrically interconnected. These core stacks are electrically connected to earth potential, which hitherto has been performed by means of a screw and toothed disc when mounting the core stack on a holder. However, effective earth contacting is not always provided in this operation, for example because of inadequate removal of insulating varnish.

Another possibility is to press a metallic sleeve into recesses or holes in the core stack. During this pressing-in process, the insulating layer at the points of contact—inner wall of the bores of the core stack and outer wall of the sleeve—is at least partially removed, thus producing the possibility of earth contacting by means of this sleeve. The core stack is mounted on a holder by screwing the sleeve, thus simultaneously producing a conductive earth connection. This earth contacting uses a relatively large quantity of material and requires a plurality of steps in the production. This method of earth contacting is not economic enough on the way to an ever more cost effective production.

SUMMARY OF THE INVENTION

Accordingly, it is an object of the present invention to provide a core of the above mentioned type, which avoids the disadvantages of the prior art.

In keeping with these objects and with others which will become apparent hereinafter, one feature of the present invention resides, briefly stated, in a core having earth contacting to a holder via a connecting element and by means of removing the insulating layer in the region of the mounting bores, wherein in accordance with the present invention, at least one lamination of the core stack is provided at the mounting bore with a projection producing the earth contact with the connecting element to be inserted into the mounting bore.

When the core is designed in accordance with the present invention, it has, by contrast, the advantage that the earth contacting between the core stack and holder is produced directly via a screw or the like, so that it is possible to dispense with the toothed disc or sleeve. The fact that the step of "pressing in the sleeve" is also saved is to be viewed as a further advantage.

It is especially advantageous that it is necessary to punch out from only one lamination a relatively small area at the later mounting point before the stacking. It is irrelevant in this case what form the punched area has. Care need only be taken to ensure that the thread of the screw is not damaged by the proud material when mounting. The seating of this correspondingly punched lamination in the core stack is likewise irrelevant.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
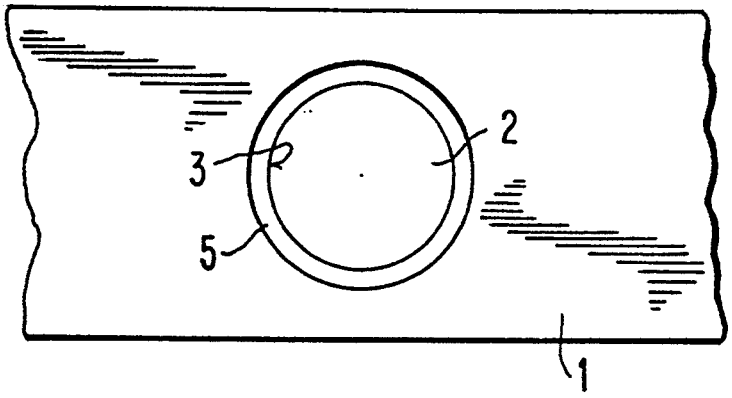
FIG. 1 shows the plan view of a core stack.
Figure 2:
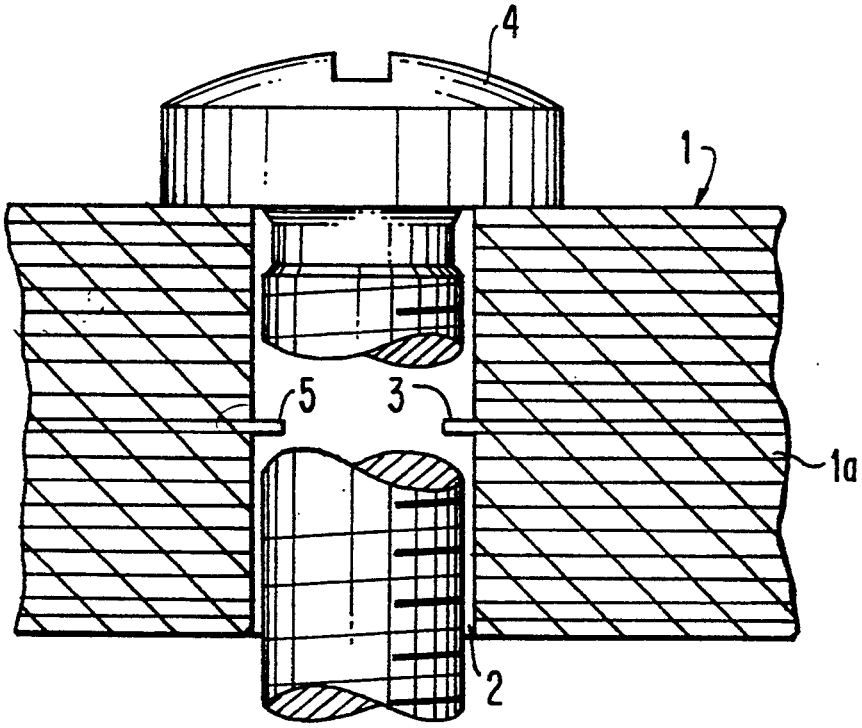
FIG. 2 the side view of the core stack from FIG. 1, with the mounting screw represented, FIG. 3 a plan view of a second core stack, and FIG. 4 the side view of the core stack from FIG. 3, with mounting screw.

FIGS. 1 and 2 are to be explained together, since they show the same object only from different views. To be seen in both drawings is the core stack 1 made from laminations which are coated with insulating varnish and have a bore 2, it being the case that, but for at least one lamination 1*a*, all the remaining laminations have this diameter of the bores 2. At least one lamination 1*a* has a smaller diameter 3. In this case, it is wholly immaterial at which point in the core stack this lamination 1*a*, having the smaller diameter 3, is arranged. The remaining laminations have the diameter 2, this diameter being selected precisely such that a mounting screw 4 can be plugged into this bore 2 with play without any problem. When being turned, the mounting screw 4 acts like a thread cutter and thus cuts a "partial thread" in the projecting lamination 1*a* at the proud material projection 5, the insulating varnish in this region of the lamination 1*a* being removed and an earth contact being simultaneously closed with the screw 4. Thus, earth contacting is undertaken without additional outlay when screwing down the core stack onto a holder. The relatively small diameter 3 of the one lamination 1*a* is selected in this case such that the screw 4 can be screwed into the thread without damaging it.

Figure 3:
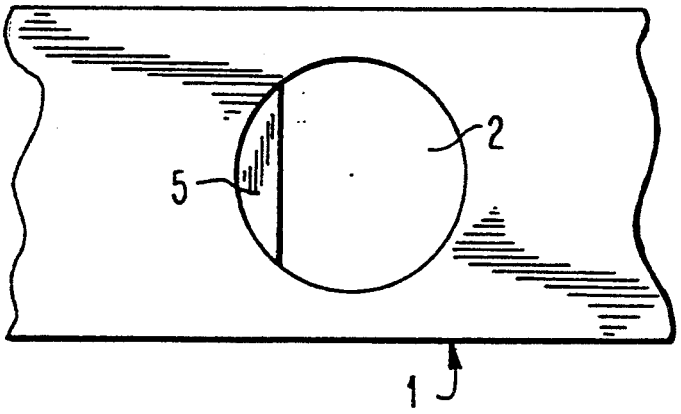
Figure 4:
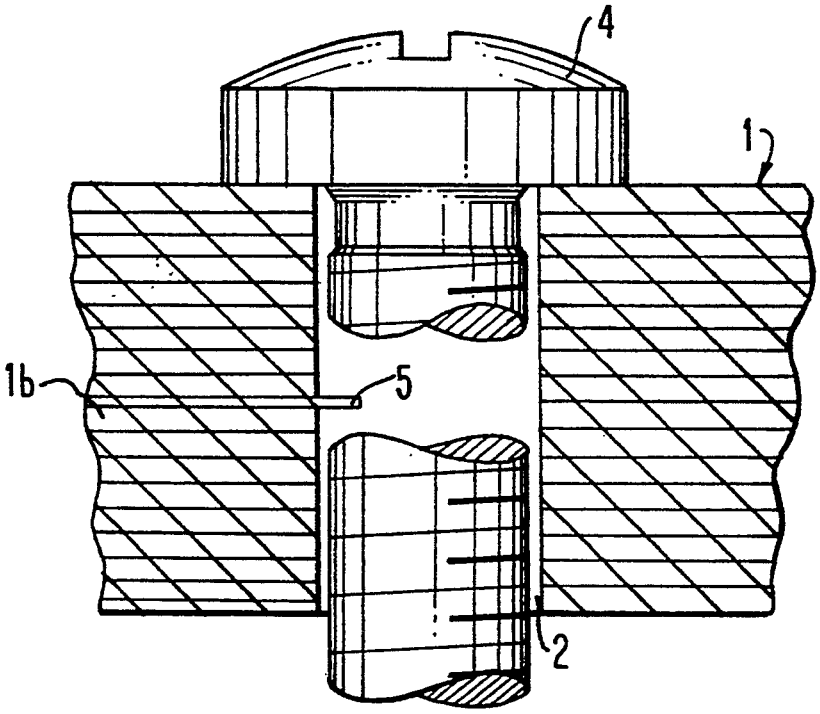

A further possibility for constructing a lamination is shown in FIG. 3 and FIG. 4. Here, although the one lamination 1*b* is punched with the same diameter as the remaining laminations of the core stack 1, in the case of this one lamination a material residue in the form of a segment in accordance with FIG. 3 and projecting into the bore 2 remains here, as well. This proud material 5 is selected such that without damaging the thread the screw 4 removes the insulating varnish of the lamination 1*a* there and produces an earth contact by means of a "partial thread".

It is also possible to select for the other, differently shaped lamination a different, arbitrary cross-section of the perforation, thus that of a toothed disc, for example. It is important in all cases that the area of the material removed is smaller than that of the remaining laminations which are stacked together to form the core stack, and that the remaining opening is larger than the core cross-section of the screw 4.

In the case of a sufficiently elastic lamination 1*a*, it is also possible to select a larger amount of proud material 5 in the bore 2, which gives way in the screwing direction upon insertion of the screw 4 and then presses into the screw thread with its edge freed from insulating varnish. Furthermore, instead of a screw it is also possible to use a rivet or a similar connecting element.

It will be understood that each of the elements described above, or two or more together, may also find a useful application in other types of constructions differing from the types described above.

While the invention has been illustrated and described as embodied in a core, in particular for an ignition coil, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A core for an ignition coil, comprising a core element formed as a core stack with a plurality of laminations and having a mounting bore with an insulating layer; a connecting element for connecting said core element to a holder and inserted in said mounting bore; and means for establishing an earth contact between said core element and said connecting element, said means including a projection formed by at least one of said laminations of said core stack formed so that said projection extends into said mounting bore and when said connecting element is inserted into said mounting bore it removes said insulating layer from said projection and establishes the earth contact.

2. A core as defined in claim 1, wherein said connecting element is formed as a screw, said projection being provided with a partial thread engageable with said screw for producing the earth contact.

3. A core as defined in claim 1, wherein said connecting element is formed as a screw, said projection being formed as a segment extending into said mounting bore and engaging with said screw.

4. A core as defined in claim 1, wherein said mounting element is a screw, said projection being formed so that during insertion of said screw in said mounting bore said projection gives away in a screwing direction.

5. A core as defined in claim 1, wherein said connecting element is formed as a mounting screw, said projection being formed so that a mounting screw can be screwed in said mounting bore without damaging a thread of said mounting screw.

* * * * *